US005244205A

United States Patent [19]

Melanson et al.

[11] Patent Number: 5,244,205

[45] Date of Patent: Sep. 14, 1993

[54] ADJUSTABLE LIE ANGLE GOLF CLUB PUTTER

[75] Inventors: Daniel A. Melanson, Avon, Conn.; Joseph F. Baltronis, Agawam; Walter J. Polaski, Westfield, both of Mass.

[73] Assignee: Lisco, Inc., Tampa, Fla.

[21] Appl. No.: 936,461

[22] Filed: Aug. 28, 1992

[51] Int. Cl.[5] ..... A63B 53/02; A63B 53/06

[52] U.S. Cl. ..... 273/79; 273/80.1

[58] Field of Search ..... 273/80.1-80.9, 273/79; 15/176.1, 176.6; 403/59, 61, 83, 84, 113

[56] References Cited

U.S. PATENT DOCUMENTS

| | | | |
|---|---|---|---|
| 749,174 | 1/1904 | Davis | 273/79 |
| 1,352,020 | 7/1920 | Olson . | |
| 1,550,665 | 8/1925 | Barnes . | |
| 1,599,336 | 9/1926 | Lindgren | 273/80.1 |
| 1,765,982 | 6/1930 | Keating . | |
| 2,644,689 | 7/1953 | Putnam | 273/79 |
| 2,661,952 | 12/1953 | Jackson | 273/80.1 |
| 2,708,579 | 5/1955 | Hugman | 273/79 |
| 2,932,515 | 4/1960 | May | 273/80.1 |
| 3,096,982 | 7/1963 | Bassin | 273/80.1 |
| 3,191,936 | 6/1965 | Guier | 273/80.2 |
| 3,204,962 | 9/1965 | McCormick | 273/80.1 |
| 3,214,170 | 10/1965 | Warnock | 273/80.1 |
| 3,430,957 | 3/1969 | Andis | 273/80.1 |
| 4,073,492 | 2/1978 | Taylor | 273/80.2 |
| 4,655,457 | 4/1987 | Thompson | 162/162 R |
| 4,763,951 | 4/1988 | Grant | 273/79 |
| 4,815,740 | 3/1989 | Williams et al. | 273/80.1 |
| 4,881,737 | 11/1989 | Mullins | 273/80.1 X |

FOREIGN PATENT DOCUMENTS

| | | | |
|---|---|---|---|
| 9169 | 1/1909 | United Kingdom | 273/79 |
| 1118181 | 6/1968 | United Kingdom | 273/80.1 |

*Primary Examiner*—V. Millin
*Assistant Examiner*—Sebastiano Passaniti
*Attorney, Agent, or Firm*—Donald R. Bahr; John E. Benoit

[57] ABSTRACT

An adjustable lie angle putter having an infinite degree of adjustment between a 56° and 79.9° angle from the zero ground plane. The putter head has an elongated slot therein located on the upper surface of the putter with aligned boreholes in the walls of the slot. The shaft is secured to a hosel member which terminates in a tang having parallel flat sides which mate with the slot. A borehole extends through the tang between the flat sides. A pin is secured in said boreholes so as to pivotally secure said tang in said slot. The upper surface of the tang forms arcuate surfaces on opposite sides of the shaft which terminate in flat planar surfaces. The flat planar surfaces terminate in two substantially flat bearing surfaces which meet at an angle. Two threaded boreholes extend angularly through the sole of the putter into the slot and two adjustable setscrews are secured with the boreholes. When the tang is pivotably secured in the slot by the pin, the angle of the shaft may be set by rotating the tang and then securing the setscrews, each of which mates with an associated flat bearing surface. Additionally, the flat planar surfaces limit the degree of adjustment by mating with the end walls of the slot when maximum clockwise and counterclockwise pivotal movement is reached.

5 Claims, 1 Drawing Sheet

ADJUSTABLE LIE ANGLE GOLF CLUB PUTTER

This invention relates generally to putters and more specifically to a putter wherein the lie angle may be adjusted by the user.

Golf club putters, in addition to having many different types of heads, also are made with different lie angles, which is the angle of the shaft relative to the zero ground plane. In purchasing a putter, the user usually practices with several different putters to ascertain if he likes the weight, the particular head configuration, the length, and the particular lie angle of the putter. Each individual has his own style of putting and the lie angles can vary considerably in order to mate with that particular style of putting. This means that should a player change his style of putting, which very often happens, particularly over the years, then he must either change putters or have it reconfigured with a shaft so that it will fit his style of putting.

Accordingly, it is an object of this invention to provide a golf club putter having a lie angle which is adjustable by the user.

It is a further object of this invention to provide a putter which permits adjustment of the lie angle by the user of less than 80° from the zero ground plane.

SUMMARY OF THE INVENTION

An adjustable lie angle putter having a degree of adjustment of an angle less than 80° from the zero ground plane is provided. The putter head has an elongated slot forming two walls and two end surfaces with opposed boreholes through the walls. The shaft terminates in a hosel member and the hosel member terminates in a tang which has two substantially parallel faces and two arcuate surfaces between said parallel faces extending on opposite sides downwardly from the hosel member, with these surfaces terminating in two substantially flat planar surfaces. At the distal ends of said flat planar surfaces are two substantially flat faces which meet each other at the bottom of the hosel member at a selected angle. A borehole is provided between the two parallel faces of the tang so that when the tang is placed within the slot, the borehole mates with the borehole through one wall of the slot and a borehole in the other wall which terminates short of the outer surface of the wall. This permits the tang and, thus, the shaft to be pivotably secured within the slot by means such as a pin. The underside of the putter has two threaded boreholes extending at an angle from the sole to the interior of the slot. Adjustable setscrews are secured within the boreholes, with one setscrew mating with one of the flat faces at the bottom of the hosel and the other mating with the remaining flat face. Accordingly, when the shaft is adjusted to the desired angle with the zero ground plane, the setscrews are then adjusted so that they mate with their associated flat surfaces so as to secure the shaft in position. Additionally, the flat planar surfaces on the tang mate with the end walls of the slot so as to limit the angle of adjustment between preset angles of, for instance, 59° to less than 80° from the zero ground plane.

DETAILED DESCRIPTION OF THE PREFERRED EMBODIMENT

Figure 1:
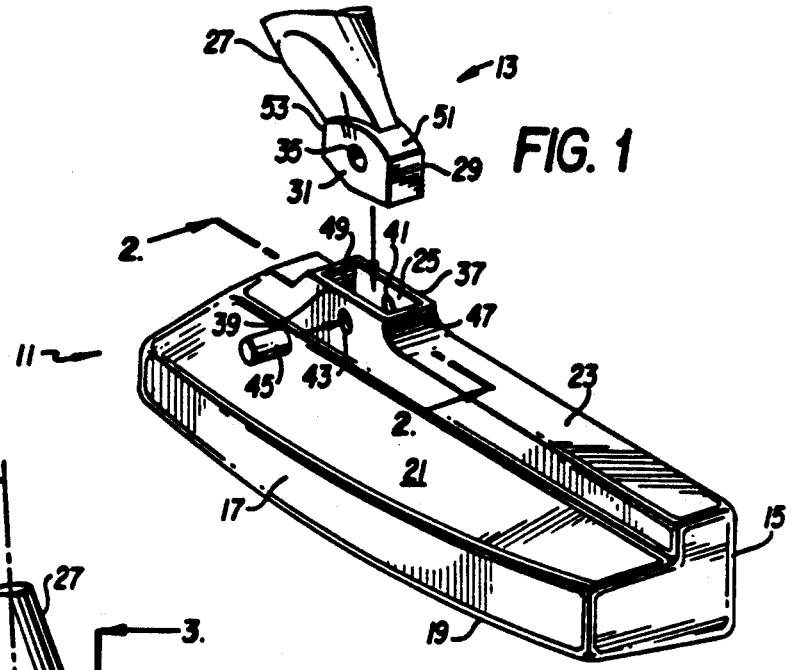
FIG. 1 is an exploded perspective view of one embodiment of the hosel and head of the putter of the present invention.

FIG. 1 is an exploded view of one embodiment of the present invention. As shown, putter head 11, having a particular configuration, has a striking face 15, rear flange 17, sole 19, and an upper surface 21. A substantially rectangular slot is formed in the raised upper surface 23 of the putter and extends downwardly and terminates within the putter, as more clearly shown in FIGS. 2 and 3. The slot includes side walls 37 and 39 and end surfaces 47 and 49. Side walls 37 and 39 have aligned boreholes 41 and 43 with borehole 43 passing through wall 39 and borehole 41 terminating short of the outer surface of wall 37.

Golf club shaft 13 includes hosel member 27, with the hosel member terminating in a tang having two substantially parallel flat faces 29 and 31. Borehole 35 extends through the tang between flat faces 29 and 31. When the tang is placed within slot 25, borehole 35 aligns with the boreholes 41 and 43 in the walls of the slot and the tang and, thus, the hosel and shaft are pivotally secured therein by means such as a pin 45 which functionally fits within borehole 35, 41, and 43.

Figure 2:
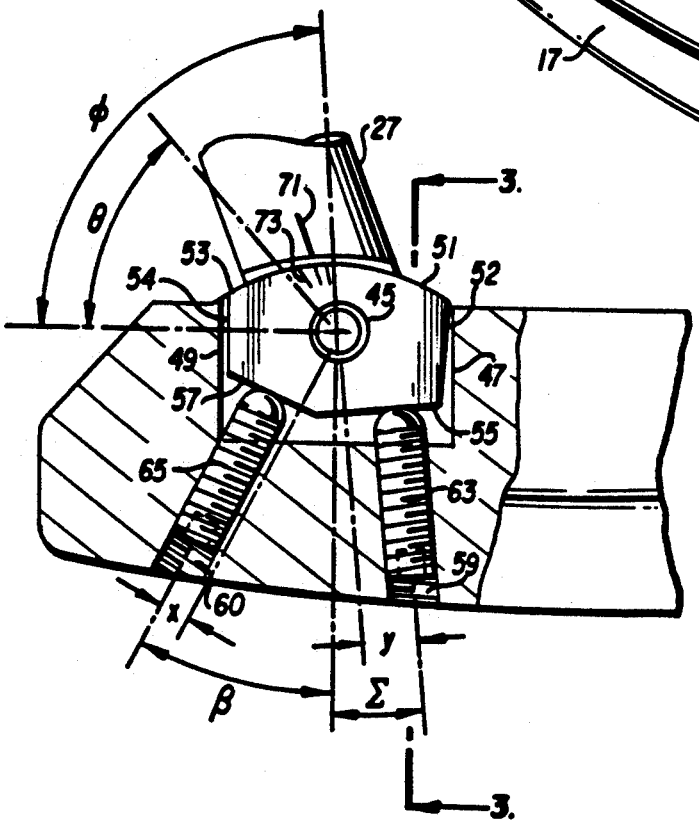
FIG. 2 is a partial sectional view taken through the lines 2—2 of FIG. 1.
Figure 3:
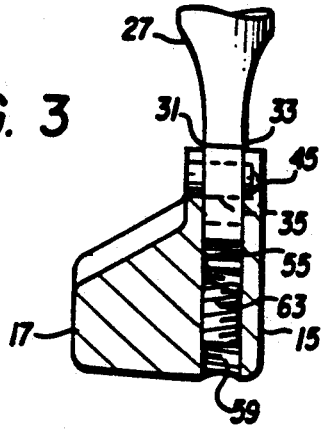
FIG. 3 is a partial sectional view taken through the lines 3—3 of FIG. 2.

Referring to FIGS. 2 and 3, one embodiment of the geometrical configuration of the tang can be seen wherein arcuate surfaces 51 and 53 extend downwardly from opposite sides of hosel member 27. These arcuate surfaces terminate in two substantially flat planar surfaces 52 and 54. Planar surfaces 52 and 54 terminate in flat bearing surfaces 55 and 57, which meet so as to form an angle $\alpha$. The axes of threaded boreholes 59 and 60 extend at angles $\Sigma$ and $\beta$ from the ground plane. The tang has three hash marks 73 which are opposed to a single hash mark 71 on the hosel. This provides a reference for a user who wishes to alter the angle and then return to a previously set angle. Boreholes 59 and 60 extend to slot 25. Setscrews 63 and 65 are adjustable within threaded boreholes 59 and 60. It should be noted that the axes of the boreholes are positioned off center to pivot pin 45 by distances x and y, as shown. This produces a positive or negative moment, thereby giving resistance as the screws are engaged.

When the tang is in the slot, surfaces 52 and 54 are opposed to adjacent bearing walls 47 and 49. Flat faces 29 and 31 are of a dimension so as to provide frictional engagement with the interior of walls 37 and 39. In order to adjust the putter head, setscrews 63 and 65 are backed off and the user adjusts the position of the tang at the end of hosel member 27 within slot 25 by moving the shaft. When the desired position is reached, setscrews 63 and 65 are moved so as to abut against flat bearing surfaces 55 and 57. The combination of the abutting setscrews and the frictional contact of pin 45 secures the shaft in the desired position. If it is desired to change the angle, the setscrews are backed off and the procedure is repeated.

In the particular embodiment shown, the shaft may be adjusted between an angle $\theta$ and an angle $\phi$ relative to the zero ground plane. This angle is preferably between 56° and 79.9°. As will be obvious, this permits infinite adjustment between those two angles while fully complying with U.S.G.A. requirements that the sole of the putter must diverge from the vertical in the toe-heel plane by at least 10° when the club is in its normal address position.

The configuration of the tang determines the limit of movement of the hosel and, thus, of the shaft. The planar surfaces 52 and 54 determine such movement. Referring to FIG. 2, it can be seen that if hosel 27 is rotated counterclockwise beyond the position shown, planar surface 52 will contact end wall 47 and prevent counterclockwise movement beyond angle $\theta$. Likewise, clockwise movement of hosel 27 will eventually result in contact of planar surface 54 with wall 49 so as to prevent rotation of the hosel below the angle $\phi$. As stated above, angle $\phi$ is less than 80° and $\theta$ is preferably no less than 56°.

If it is necessary in order to meet U.S.G.A. rules, setscrews can be provided which may be adjusted only with a special tool and, therefore, could not be adjusted during the course of a round of play.

Figure 4:
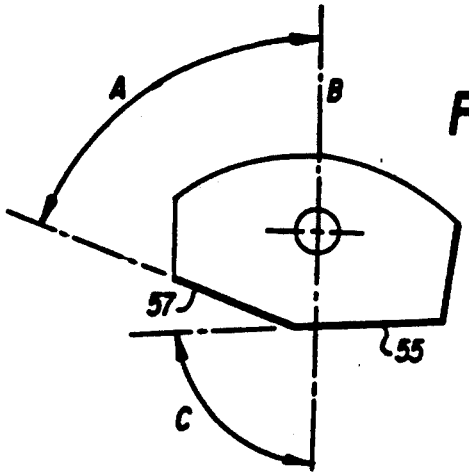
FIG. 4 is a side view of the tang on the hosel member on the shaft, illustrating various angles relative to the geometrical configuration thereof.

FIG. 4 is an illustration of one preferred configuration of the hosel member showing angles A and C with reference to the vertical B. Referring to FIGS. 2 and 4, one specific embodiment of the present invention uses the following dimensions, with the line B in FIG. 4 being perpendicular to the ground plane:

| | |
|---|---|
| Offset x | = 0.070 in. |
| Offset y | = 0.170 in. |
| A | = 67.0° |
| C | = 86.0° |
| $\beta$ | = 25.0° |
| $\Sigma$ | = 5.0° |
| $\phi$ | = 79.9° |
| $\Theta$ | = 56.0° |

With the above parameters, the hash marks are placed such that when the hash mark on the hosel mates with the center hash mark on the tang, the lie angle is 70° when screws 63 and 65 are perpendicular to bearing surfaces 55 and 57, respectively.

The above description and drawings are illustrative only since various modifications could be made without departing from the invention, the scope of which is to be limited only by the following claims.

We claim:

1. An adjustable lie angle putter having a shaft comprising a hosel member at a distal end of the shaft, said hosel member terminating in a tang, said tang comprising two opposed substantially parallel flat faces;

a borehole in said tang extending between said flat faces;

first and second arcuate surfaces adjacent to and extending downwardly on opposite sides of the shaft and terminating in flat planar surfaces;

said flat planar surfaces terminating in first and second substantially flat bearing surfaces, said bearing surfaces meeting so as to form an angle between said faces;

a putter head having a striking face, sole, and top surface;

a slot in the top surface of said putter head, said slot having two substantially parallel side walls having inner and outer surfaces, said side walls terminating in two end surfaces, the geometrical configuration of said slot being of a dimension to accept said tang;

a borehole in each of said side walls mating with the borehole in said hosel member, the borehole in one of said walls terminating short of the outer surface of the wall;

a pin secured in said boreholes for pivotally securing said tang to said putter head;

first and second threaded boreholes in the sole of said putter extending to said slot, the axes of said threaded boreholes being angled toward each other and being off center relative to said pin; and first and second adjustable setscrews in said first and second threaded boreholes, said first setscrew being aligned so as to meet with said first flat face and said second setscrew being aligned so as to meet with said second flat face of said hosel member.

2. The putter of claim 1 wherein said opposed substantially flat parallel faces frictionally engage the inner surfaces of the side walls of said slot.

3. The putter of claim 1 wherein said flat planar surfaces mate with the adjacent end surfaces of said slot when the shaft is adjusted to its extreme rotational positions.

4. An adjustable lie angle putter having a shaft comprising a hosel member at a distal end of the shaft, said hosel member terminating in a tang, said tang comprising two opposed substantially parallel flat faces;

a borehole in said tang extending between said flat faces;

first and second arcuate surfaces adjacent to and extending downwardly on opposite sides of the shaft and terminating in flat planar surfaces;

said flat planar surfaces terminating in first and second substantially flat bearing surfaces, said bearing surfaces meeting so as to form an angle between said faces;

a putter head having a striking face, sole, and top surface;

a slot in the top surface of said putter head, said slot having two substantially parallel side walls having inner and outer surfaces, said side walls terminating in two adjacement end surfaces, the geometrical configuration of said slot being of a dimension to accept said tang, said flat planar surfaces mating with the adjacent end surfaces of said slot when the shaft is adjusted to its extreme rotational positions;

a borehole in each of said side walls mating with the borehole in said hosel member, the borehole in one of said walls terminating short of the outer surface of the wall;

a pin secured in said boreholes for pivotally securing said tang to said putter head;

first and second threaded boreholes in the sole of said putter extending to said slot; and first and second adjustable setscrews in said first and second threaded boreholes, said first setscrew being aligned so as to meet with said first flat face and said second setscrew being aligned so as to meet with said second flat face of said hosel member.

5. The putter of claim 4 wherein the mating of said planar flat surfaces and said end surfaces of said slot limit the adjustment of the lie angle to less than 80° and no less than 56° from the zero ground plane.

* * * * *